US006831557B1

(12) United States Patent
Hess

(10) Patent No.: US 6,831,557 B1
(45) Date of Patent: Dec. 14, 2004

(54) METHOD OF PROVIDING ALARM BASED WIRELESS SECURITY MONITORING

(75) Inventor: Brian K. Hess, Westerville, OH (US)

(73) Assignee: Tattletale Portable Alarm Systems, Inc., Columbus, OH (US)

( * ) Notice: Subject to any disclaimer, the term of this patent is extended or adjusted under 35 U.S.C. 154(b) by 0 days.

(21) Appl. No.: 09/534,293

(22) Filed: Mar. 23, 2000

(51) Int. Cl.[7] ..... G08B 1/08

(52) U.S. Cl. ..... 340/539.16; 340/506; 340/539.1; 340/539.14; 340/3.1; 340/825.36; 340/825.49

(58) Field of Search ..... 340/506, 507, 340/517, 521, 539.1, 534.14, 539.16, 3.1, 825.36, 825.49

(56) References Cited

U.S. PATENT DOCUMENTS

| | | | | |
|---|---|---|---|---|
| 4,091,371 A | | 5/1978 | Mason, Jr. et al. | 340/546 |
| 4,194,193 A | | 3/1980 | McDonough | 340/545 |
| 4,222,119 A | | 9/1980 | Brunner-Schwer | 340/546 X |
| 4,264,899 A | | 4/1981 | Menzies et al. | 340/546 |
| 4,435,701 A | | 3/1984 | Baon | 340/546 |
| 4,520,351 A | | 5/1985 | Altman et al. | 340/574 |
| 4,667,188 A | | 5/1987 | Schwartz | 340/689 |
| 4,719,454 A | | 1/1988 | Hopkins et al. | 340/574 |
| 4,742,336 A | | 5/1988 | Hall et al. | 340/539 |
| 4,777,474 A | | 10/1988 | Clayton | 340/539 |
| 4,904,983 A | | 2/1990 | Mitchell | 340/426 |
| 4,908,604 A | | 3/1990 | Jacob | 340/539 |
| 4,910,493 A | | 3/1990 | Chambers et al. | 340/426 |
| 4,951,029 A | | 8/1990 | Severson | 340/539 X |
| 4,964,156 A | | 10/1990 | Blair | 379/189 |
| 5,019,803 A | | 5/1991 | Maram | 340/539 |
| 5,081,667 A | | 1/1992 | Drori et al. | 379/59 |
| 5,117,223 A | | 5/1992 | Tanner | 340/541 X |
| 5,144,661 A | | 9/1992 | Shamosh et al. | 380/9 |
| 5,164,705 A | | 11/1992 | Dunagan et al. | 340/547 |
| 5,200,735 A | | 4/1993 | Hines | 340/539 |
| 5,225,713 A | | 7/1993 | Henneberry et al. | 307/102 |
| 5,255,306 A | | 10/1993 | Melton et al. | 379/38 |
| 5,289,534 A | | 2/1994 | Lester et al. | 340/545 X |
| 5,311,570 A | | 5/1994 | Grimes et al. | 379/57 |
| 5,319,698 A | | 6/1994 | Glidewell et al. | 340/541 X |
| 5,512,881 A | | 4/1996 | Majmudar | 340/541 X |
| 5,587,701 A | | 12/1996 | Hess | 340/541 |
| 5,680,112 A | | 10/1997 | Xydis | 340/539 X |
| 5,777,551 A | | 7/1998 | Hess | 340/541 |
| 5,850,180 A | * | 12/1998 | Hess | 340/539 |
| 6,049,273 A | * | 4/2000 | Hess | 340/539 |

* cited by examiner

*Primary Examiner*—Daryl Pope

(57) ABSTRACT

A method of providing simple, low-cost and effective alarm system protection. The method is especially useful in locations where the installation of a conventional, hard-wired alarm system would be impossible or economically impractical. The method utilizes a portable alarm system which incorporates wireless technology along with wireless transmission service, therefore providing the ability to protect virtually anything, anywhere, at any time. The present invention also provides for both automated and manned monitoring of the alarm location by a security monitoring company, which may be contacted at any time, from any location, at a single phone number or internet address, for example. The method of the present invention also utilizes a method of call retainment and multiple redundancy to ensure that any calls placed by the portable alarm system are received by the security monitoring company. Additionally, the present invention contemplates a method by which false alarms after initial set up of the alarm system may be reduced, and also a method which allows the user of the alarm system to abort known false alarms by contacting the security monitoring company.

70 Claims, 3 Drawing Sheets

METHOD OF PROVIDING ALARM BASED WIRELESS SECURITY MONITORING

BACKGROUND AND SUMMARY OF THE INVENTION

The present invention relates generally to the set up of an alarm system, and more particularly, to a portable alarm system for use in a residence, boat, office, or any other location which may benefit from security monitoring.

Alarm systems of various types have been in existence for many years. In known home alarm systems, the components are usually hard-wired throughout the home with the wiring generally terminating at a control panel located somewhere therein. These alarm systems are often connected to the home's telephone wiring for placement of a call to a monitoring station if an illegal entry is detected. One of the chief drawbacks of such an alarm system is that the installation process may be very labor intensive and, therefore, costly. Another drawback of this type of alarm system is that the cutting of the home's telephone wiring effectively paralyzes the alarm system.

Additionally, the present day security alarm market offers few alternatives for the many people that live in apartments or hotel rooms, lease office space or short term warehousing, or wish to protect motor homes, boats, construction trailers, or a multitude of other environments wherein the installation of a permanent alarm system may be physically impossible or would be economically impractical. Ironically, it is often these environments where the crime rate is the highest. Therefore a need exists for an alarm system that is portable, which is relatively inexpensive, which is easy to set up and use, and which does not have to rely on a building's installed telephone or power lines.

The present invention discloses a method of alarm system set up that can be fully accomplished in minimal time by the user of the alarm system. The method utilizes a portable alarm system that incorporates wireless technology along with wireless transmission service. The alarm system is highly portable, as virtually all of the necessary components are housed within a single enclosure. The alarm system is designed to communicate with an automated call station or central monitoring station of a security monitoring company. The security monitoring company may be contacted at any time from any location. This allows monitoring to be initiated at new locations by simply contacting the security monitoring company and providing the phone number and location.

With the method and device of the present invention, door and window entries may be monitored, motion within a room may be detected with a preferred motion detector, and smoke may be identified with a smoke detector - all without the intrusive, labor intensive process typically required to install a comparable hard-wire system. Additionally, although the above description is directed toward indoor use, the portable alarm system of the present invention is equally useful for protecting outdoor areas as well. In short, the method and device of the present invention enables the user to protect practically anything, practically anywhere, practically anytime, by simply connecting the portable alarm system to an appropriate power source and contacting the security monitoring company.

In one preferred embodiment of the present invention, a user contacts or visits a provider to purchase a portable alarm system. During the purchase, certain information may be obtained from the user for providing to the security monitoring company. The alarm system is then shipped to the user, or alternatively, is taken home by the user if purchased in a store. The only task required of the user is connection of the portable alarm to an appropriate power source. The user may also mount optional, self-adhesive door and window sensors. In one preferred embodiment, the provider of the alarm system will have contacted the security monitoring company and supplied the necessary information to initiate service, before the user of the alarm system completes its set up. Thus, upon connection of the portable alarm to an appropriate power source, the user will have a functional home security system.

Alternatively, the user may contact the security monitoring company to initiate monitoring service. In this case, the user does not need to supply the provider with all of the information necessary to initiate monitoring service. A user may wish to contact the security monitoring company at the outset, especially if the user does not intend to set up the alarm system immediately. The user will also be able to initiate monitoring service at any location to which the alarm system is transported by simply contacting the security monitoring company and updating the information.

The present invention also contemplates an improved method for assuring that a call placed by the alarm system to the call station or central monitoring station of the security monitoring company is received. The method of the present invention utilizes a redundant system to ensure that once the alarm system places a call, the call will be held and resent by an off-premise wireless transport station should the first attempt not result in an answer. If, after multiple resends the call has still not been answered, the call may be rerouted to another call or monitoring station. In this manner, there can be reasonable assurance that the call will be received and processed, and the proper authorities dispatched, even if the alarm system is destroyed after an initial call has been made.

It can be seen from the above description that the present invention provides a simple, cost effective and efficient method of providing alarm based wireless security monitoring. The present invention also discloses an improved method of ensuring that a call from the alarm system is received an acted on by the security monitoring company. The method of the present invention may be particularly useful in environments where the installation of a permanent alarm system would be physically impossible or economically impractical.

BRIEF DESCRIPTION OF THE DRAWINGS

In addition to the novel features and advantages mentioned above, other objects and advantages of the present invention will be readily apparent from the following descriptions of the drawings and preferred embodiments, wherein.

DETAILED DESCRIPTION OF THE PREFERRED EMBODIMENTS

The method of the present invention is directed to providing portable, simple, cost effective and dependable alarm based wireless security monitoring. The present invention makes use of a portable alarm system that incorporates wireless technology along with wireless transmission service. A portable alarm system as contemplated by the present invention is disclosed in U.S. Pat. Nos. 5,587,701, 5,777,551 and 5,850,180, all of which are hereby incorporated by reference herein.

Figure 1:
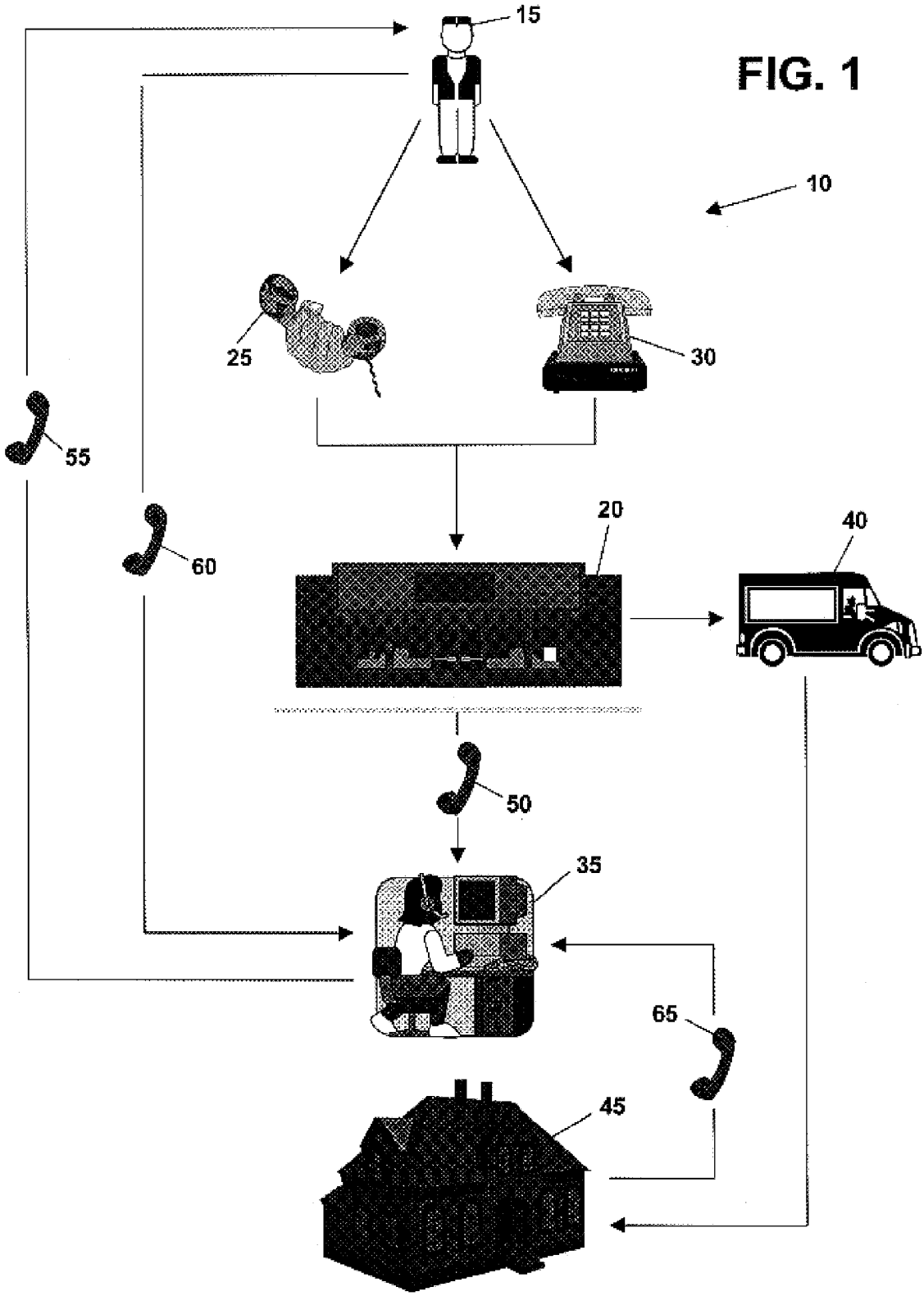
FIG. 1 is a pictorial flowchart describing a preferred embodiment of the method of the present invention, wherein an alarm system is set up and security monitoring service is obtained.

A preferred embodiment of the method 10 of the present invention can be seen by reference to FIG. 1. If a portable alarm system has not yet been obtained, then a user 15 contacts a provider 20 to purchase a portable alarm system. The user 15 may contact the provider by phone 25 or via the internet 30, for example. Alternatively, the user 15 may personally visit the provider 20 to make the purchase.

The present invention contemplates the use of a designated security monitoring company 35, which may have either an automated call station or a manned, central monitoring station. The use of a designated security monitoring company simplifies the process of providing monitoring service to new locations of the portable alarm system. If the user 15 desires to have the provider 20 open an account with the security monitoring company 35, then the user 15 supplies the provider with the necessary information during the sale of the portable alarm system. The information necessary to establish security monitoring service may include the name of the user, the address of the location to be protected, the names of the relevant local authorities, and preferably a user password.

If the purchase of the portable alarm system is made via telephone 25, internet 30 or some other remote means, then the provider 20 may utilize a shipper 40 to deliver the portable alarm system. If the user 15 made the purchase by visiting the provider 20 directly, the user will typically transport the portable alarm from the provider. The portable alarm system is delivered by the shipper 40, or alternatively, transported by the user 15 for eventual installation in a particular location 45. The location to be protected 45 may be the user's residence, an office, a warehouse, or a boat, for example.

If the user 15 has elected to have the provider 20 initiate security monitoring service for the benefit of the user, then after the sale the provider will contact 50 the security monitoring company 35 to initiate service for the user. The provider 20 preferably contacts the security monitoring company 35 immediately after the sale, such that the security monitoring company can effect service by the time the user 15 has set up the portable alarm system. Preferably, the security monitoring company 35 will later contact 55 the user 15, or the user will later contact 60 the security monitoring company to confirm initiation of service. The security monitoring company 35 can be contacted via telephone, the internet, or other remote means. Although not required, a test of the portable alarm system and monitoring service may also be arranged or conducted. Additionally, the user 15 may request a period of time to become acclimated to the portable alarm system and ensuing false alarms that are likely to occur. During this period of time, the security monitoring company 35, in coordination with the user 15, may delay the initiation of service or may temporarily ignore any alarm calls emanating from the user's location.

Alternatively, the user 15 may wish to establish service from the outset. In such case, the user 15 need not supply the provider 20 with the above-mentioned information and the provider need not contact 50 the security monitoring company 35. At some point prior to or after the set up of the portable alarm system, the user 15 contacts 65 the security monitoring company 35 and provides the information necessary for the security monitoring company to initiate service at the location to be protected 45. Again, a test of the portable alarm system and monitoring service may also be arranged or conducted, and/or an acclimation period may be requested by the user 15.

As mentioned above, whether the security monitoring service is initiated by the provider 20 of the alarm system or the user 15, the user may wish to establish a password with the security monitoring company which enables the user to terminate the notification process should the user become aware of an obvious false alarm. The user 15 may terminate the notification process by verbally communicating the password to a monitoring company representative, but preferably, may also terminate the notification process through the use of a remote device, such as a two-way pager, which has been contacted during the processing of the alarm system call. In this manner, the user 15 may prevent the needless dispatch of the police or fire department, for example, when the user is aware that the alarm is false.

Figure 2:
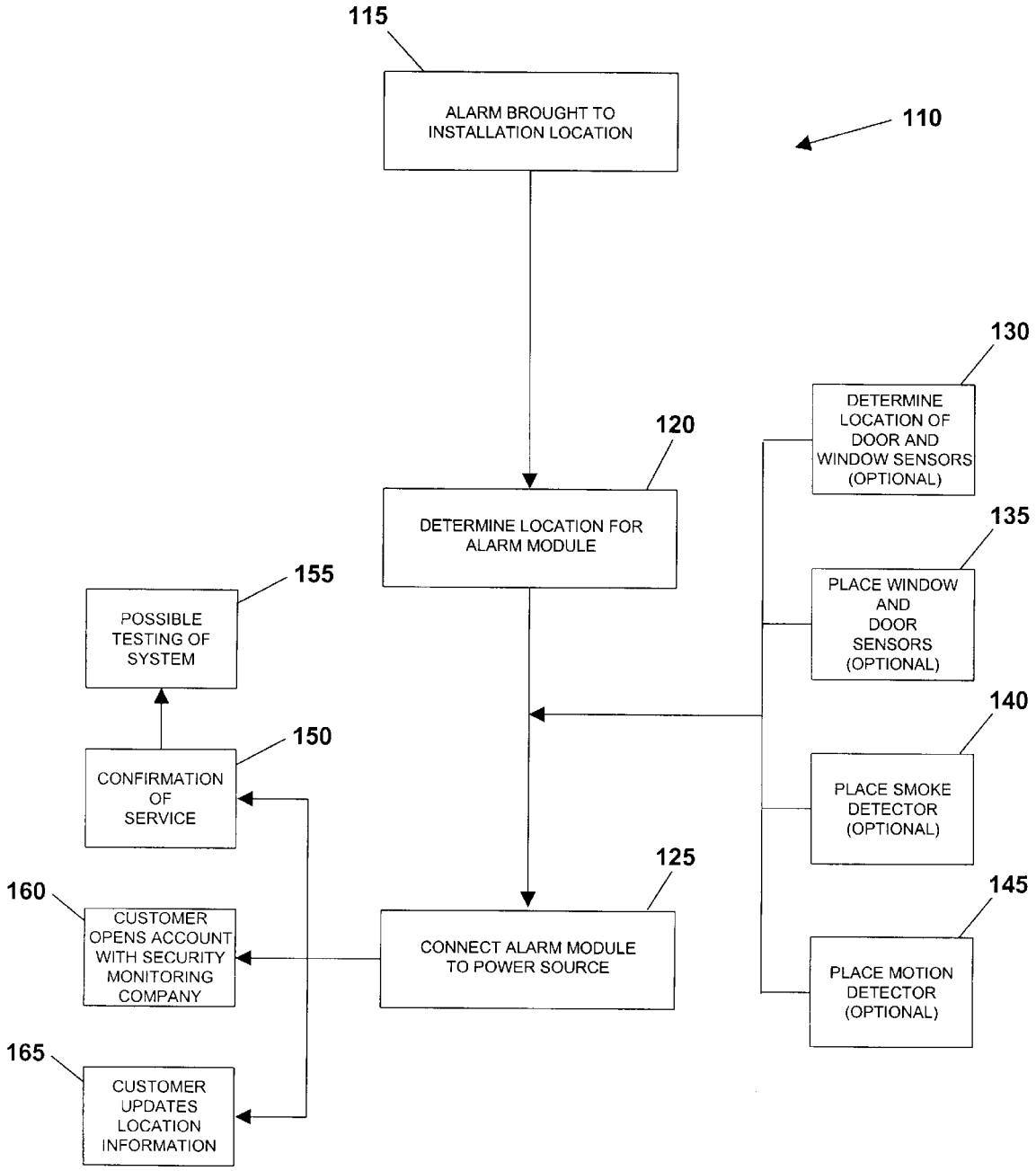
FIG. 2 is a flowchart showing the steps involved with setting up and activating an alarm system according to a preferred embodiment of the method of the present invention.

A detailed description of the actual set up of the portable alarm system according to the method of the present invention is illustrated in FIG. 2. The portable alarm system consists basically of an enclosure which may house a power supply, keypad, siren, strobe light, circuit boards, wireless transmitter, motion sensor, and other components of the portable alarm system. Preferably, the enclosure is sealed and tamperproof. The method 110 of setting up the portable alarm system is seen to require only a few steps. First, the portable alarm system is transported or delivered to the location to be protected 115. The user next determines a location 120 for the enclosure, and finally connects the alarm system to an appropriate power source 125- preferably a standard household electrical outlet or a rechargeable battery in the unit. Upon connection to the appropriate power source, the user 15 will have a functioning alarm system.

The portable alarm system may also include optional wireless accessories, such as remote sensors. The remote sensors may be used to monitor entry points into the location to be protected, such as doors and windows. Although the portable alarm system may include remote sensors, the remote sensors are not required for the portable alarm system to function. Because the portable alarm system contains a motion sensor integated within the alarm enclosure, the portable alarm system can detect a security breach without the use of the optional remote sensors.

If desired, optional equipment may be installed at the same time that the alarm system is installed, although optional equipment may also be installed at a later date. The location for remote door and window sensors may be determined 130, and the remote sensors may be installed 135. Additionally, other optional equipment, such as smoke detectors 140 or remote motion detectors 145 which are adapted for wireless communication with the alarm system may also be installed.

If the user 15 is a new customer and the provider 20 has arranged for monitoring service, then preferably either the user 15 is contacted by the security monitoring company 35, or the security monitoring company is contacted by the user to confirm service 150. If the user 15 is a new customer and the provider 20 has not arranged for monitoring service, then the user contacts the security monitoring company 35 and provides the necessary information to open an account 160. Alternatively, if the user 15 is an existing customer and has transported the portable alarm system to a new location to be protected 115, the user contacts the security monitoring company 35 to update location information 165, such as the address and names of local authorities, so that the new location is properly monitored. The security monitoring company 35 may be contacted at any time from practically any location using a single phone number or web site address, for example. The user 15 may enter the information by using a touch-tone phone in conjunction with translating software located at the security monitoring company, by speaking to a monitoring company representative, or may also enter location information online or by other remote means. In this manner, security based monitoring may be provided at a variety of locations, at any time, and with little expense and minimum effort.

Figure 3:
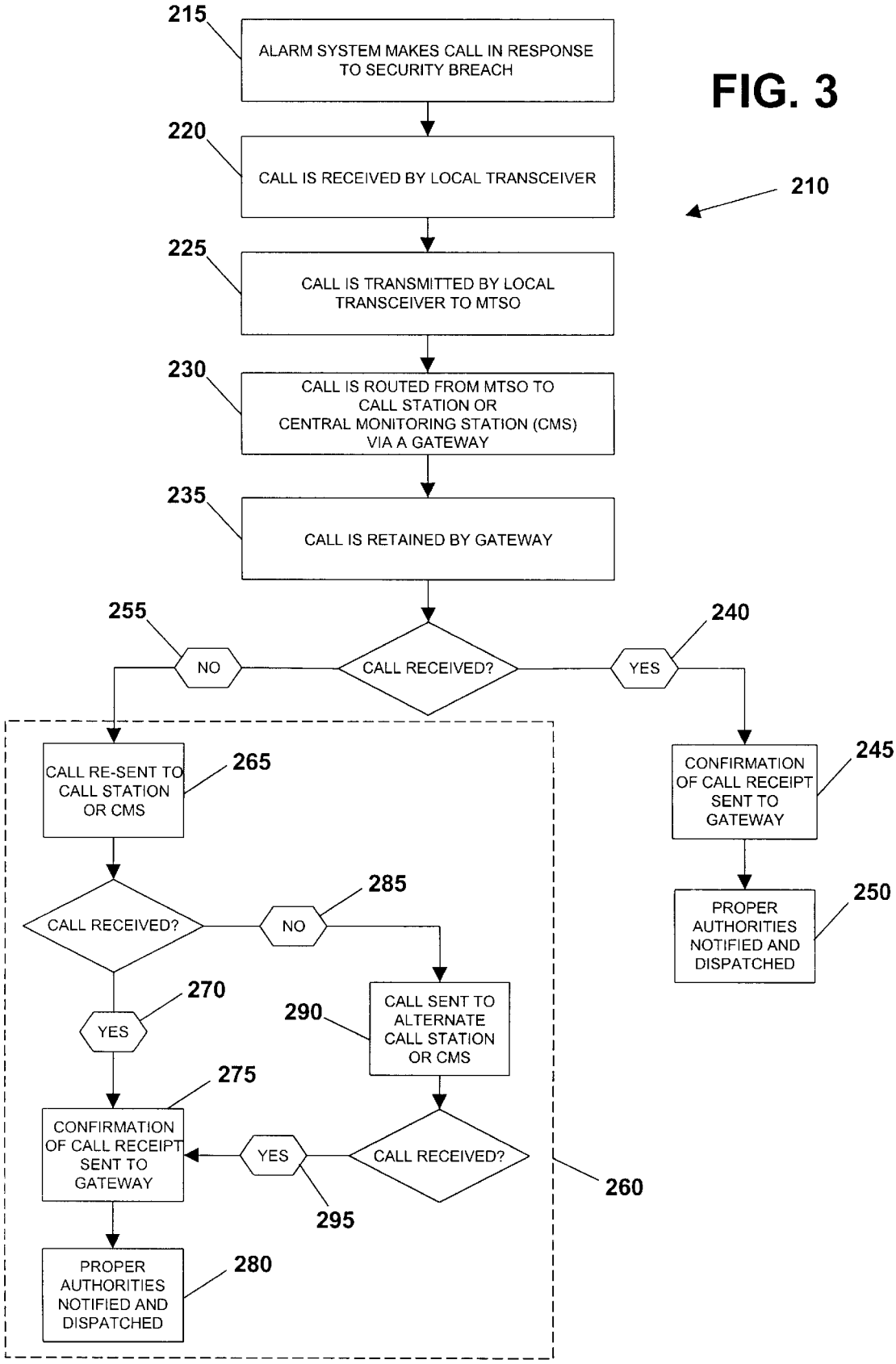
FIG. 3 is a flowchart illustrating another aspect of a preferred embodiment of the method of the present invention, wherein a call from an alarm system may be re-sent if not received by a security monitoring company.

FIG. 3 illustrates another aspect of the present invention, which is to ensure that any calls placed by the portable alarm system to a call station or central monitoring station of the security monitoring company 35 are properly received. When a typical wireless call takes place, the call goes out to a transceiver station located in the area. The transmitter, or transmission tower portion of the transceiver transfers the call to a mobile telephone switching office (MTSO), which connects the call to a public switched telephone network. The public switched telephone network then delivers the call to its intended destination.

A problem with sending a traditional wireless based call from an alarm system is that the signal sent from the transmitter to the MTSO is not retained by either the transceiver station or the MTSO. If for some reason the call cannot be completed or if the call returns a busy signal, for example, the call will not be sent again by either the transmitter or the MTSO. Therefore, if the portable alarm system places a call which is not received by the security monitoring company for a reason such as the above, and the portable alarm is destroyed before another call can be placed, there will be no notification that a security breach has occurred.

The present invention provides a method 210 of wireless security monitoring that helps to ensure that any calls placed by the portable alarm system are received by the security monitoring company 35. In the typical situation, the portable alarm system makes a call 215 upon detecting a security breach. The call is received by a local transceiver 220, and is transmitted to an MTSO 225. The MTSO routes the call, via a gateway, to a call station or central monitoring station of the security monitoring company 230. The gateway may be a wireless data processing facility such as UPLINK Security, Inc. in Atlanta, Ga. The call from the portable alarm system to the call station or central monitoring station is preferably of a contact ID format or other acceptable software alarm messaging protocol.

In the present invention, an identifying account number is preferably sent with any call made by the portable alarm system to the security monitoring company. Accordingly, the gateway is able to identify a call as originating from a portable alarm system of the present invention, and will retain the call 235 accordingly. If the call is received 240 by the security monitoring company 35, a confirmation is sent to the gateway 245, and the proper authorities (i.e., police, fire, etc.) are contacted and dispatched 250 to the location of the portable alarm system. Upon receipt of confirmation 245 from the security monitoring company, the gateway may release the retained call.

In case the initial call from the portable alarm system is not received 255, the present invention utilizes a redundant system 260 to ensure that a call from the portable alarm system does not go unanswered. In a redundant system 260, the gateway retains and resends the call 235. Thus, if the original call is not received 255, or the call returns a busy signal, for example, the gateway is able to send the call to a call station or central monitoring station a second time 265. If the second call is received 270, a confirmation is sent to the gateway 275, and the proper authorities (i.e., police, fire, etc.) are contacted and dispatched 280 to the location of the portable alarm system.

If the second call is again not received 285, the gateway will make a third attempt to send the call, however, this time the call may be routed to an alternate call station or central monitoring station 290. Although the particular example described above utilizes triple redundancy, it should be realized that a lesser or greater number of attempts to complete the call may be made. Once the call is received 295 by either the alternate call station or monitoring station, a confirmation is sent to the gateway 275, and the proper authorities (i.e., police, fire, etc.) are contacted and dispatched 280 to the location of the portable alarm system.

An additional feature of the present invention is the ability of the gateway to notify the portable alarm system that the security monitoring company has received its call. After the call station or central monitoring station sends a confirmation to the gateway, the gateway can send a confirmation signal to the portable alarm system. The portable alarm system is then able to provide notice to the user that the call it sent has been received. This is preferably accomplished by providing a LED or similar indicator on the enclosure. In a preferred embodiment of the present invention, an indicator on the enclosure is provided to flash upon the transmission of a call by the portable alarm system. The indicator will continue to flash until the portable alarm system receives the confirmation signal from the gateway, at which point the indicator will enter a state of continuous illumination. This feature may be especially useful if, for example, the user of the portable alarm system and an intruder were concurrently in the protected area. By visually checking the indicator, the user is able to discern whether the proper authorities have been contacted.

The present invention also contemplates that the portable alarm system may place calls by any of several wireless means. The portable alarm system may utilize traditional cellular technology, as described above, or may utilize cellemetry technology, wherein alarm system calls may be transmitted over the control (non-voice) channel of a cellular system. Alternatively, the portable alarm system may utilize PCS or GSM communication. It is also possible for the portable alarm system to make use of any of these forms of wireless transmission in combination with GPS technology. The aforementioned means of wireless communication are intended for purposes of illustration and not limitation, and should not be read to limit the present invention to the specific examples referred to.

The present invention discloses a method for the set up of a simple, effective and inexpensive portable alarm system, wherein the alarm system may be quickly and easily set up and activated in minimum time, without special skills, and without the need to make permanent modification or alterations to the location to be protected. The present invention also provides the ability to contact the security monitoring company at a single phone number or internet address, for example, at any time, from any location.

Additionally, the present invention recites a method for ensuring that a call placed by the portable alarm system in response to a security breach will be received by the security monitoring company - even if the portable alarm system is destroyed after the original call is placed. While certain preferred embodiments are described above, the scope of the invention is not to be considered limited by said disclosure, and modifications are possible without departing from the spirit of the invention as evidenced by the following claims:

What is claimed is:

1. A method of providing alarm based security monitoring, said method comprising the steps of:

obtaining a wireless transmitting, portable alarm system;

contacting a security monitoring company to procure security monitoring service;

providing said security monitoring company with subscription information to activate said security monitoring service;

transporting said portable alarm system to a space to be protected; and connecting said portable alarm system to an appropriate power source;

wherein substantially no other steps are required to have a functioning, monitored alarm system.

2. The method of claim 1, wherein a provider of said portable alarm system obtains information from a user of said portable alarm system, said provider thereafter contacting said security monitoring company to establish security monitoring service for the benefit of said user.

3. The method of claim 2, further comprising the step of providing said user with a choice between more than one security monitoring company.

4. The method of claim 2, wherein said security monitoring company contacts said user to confirm initiation of said security monitoring service.

5. The method of claim 2, wherein said user contacts said security monitoring company to confirm initiation of said security monitoring service.

6. The method of claim 1, wherein said user contacts said security monitoring company and provides said subscription information necessary to establish said security monitoring service.

7. The method of claim 1, wherein a user obtains said portable alarm system from a provider by ordering said portable alarm system via a remote communication method.

8. The method of claim 1, wherein a user obtains said portable alarm system by visiting a provider.

9. The method of claim 1, wherein said transporting of said portable alarm system comprises said portable alarm system being delivered to a user at a location of said user's choosing.

10. The method of claim 1, wherein said transporting of said portable alarm system comprises said user transporting said portable alarm system from a place of sale to said place to be protected.

11. The method of claim 1, further comprising the step of installing at least one remote sensor on at least one entry point into said space to be protected, said at least one remote sensor adapted for wireless communication with said portable alarm system.

12. The method of claim 1, further comprising the step of installing at least one smoke detector in said space to be protected, said at least one smoke detector adapted for wireless communication with said portable alarm system.

13. The method of claim 1, further comprising the step of installing at least one remote motion sensor in said space to be protected, said at least one motion sensor adapted for wireless communication with said portable alarm system.

14. The method of claim 1, wherein the order of accomplishing the steps of claim 1 is as listed in claim 1.

15. A method of providing alarm based security monitoring, said method comprising the steps of:

obtaining a wireless transmitting, portable alarm system, said portable alarm system having an alarm module and at least one mountable sensor;

transporting said portable alarm system into a space to be protected;

mounting said at least one remote sensor on at least one entry point into said space to be protected;

connecting said alarm module to an appropriate power source;

contacting a security monitoring company to procure security monitoring service; and confirming initiation of said security monitoring service, wherein substantially no other steps are required to have a functioning, monitored alarm system.

16. The method of claim 15, wherein a provider of said portable alarm system obtains subscritption information from a user of said portable alarm system, said provider thereafter contacting said security monitoring company to establish security monitoring service for the benefit of said user.

17. The method of claim 16, further comprising the step of providing said user with a choice between more than one security monitoring company.

18. The method of claim 16, wherein said security monitoring company contacts said user to confirm initiation of said security monitoring service.

19. The method of claim 16, wherein said user contacts said security monitoring company to confirm initiation of said security monitoring service.

20. The method of claim 15, wherein said user contacts said security monitoring company and provides said subscription information necessary to establish said security monitoring service.

21. The method of claim 15, wherein a user obtains said portable alarm system from a provider by ordering said portable alarm system via a remote communication method.

22. The method of claim 15, wherein a user obtains said portable alarm system by visiting a provider.

23. The method of claim 15, wherein said transporting of said portable alarm system comprises said portable alarm system being delivered to a user at a location of said user's choosing.

24. The method of claim 15, wherein said transporting of said portable alarm system comprises said user transporting said portable alarm system from a place of sale to said place to be protected.

25. The method of claim 15, further comprising the step of installing at least one smoke detector in said space to be protected, said at least one smoke detector adapted for wireless communication with said portable alarm system.

26. The method of claim 15, further comprising the step of installing at least one remote motion sensor in said space to be protected, said at least one motion sensor adapted for wireless communication with said portable alarm system.

27. A method of providing alarm based security monitoring, said method comprising the steps of:

obtaining a wireless portable alarm system capable of wireless transmission, said portable alarm system having a self-contained alarm module and at least one remote, wireless sensor;

supplying a provider of said portable alarm system with subscription information from a user of said portable alarm system, said provider thereafter contacting a security monitoring company and using said subscription information to establish security monitoring service for the benefit of said user;

transporting said portable alarm system to a space to be protected;

mounting said at least one sensor on at least one entry point into said space to be protected;

connecting said alarm module to an appropriate power source; and confirming initiation of said security monitoring service, wherein substantially no other steps are required to have a functioning, monitored alarm system.

28. The method of claim 27, further comprising the step of providing said user with a choice between more than one security monitoring company.

29. The method of claim 27, wherein said security monitoring company contacts said user to confirm initiation of said security monitoring service.

30. The method of claim 27, wherein said user contacts said security monitoring company to confirm initiation of said security monitoring service.

31. The method of claim 27, wherein a user obtains said portable alarm system from a provider by ordering said portable alarm system via a remote communication method.

32. The method of claim 27, wherein a user obtains said portable alarm system by visiting a provider.

33. The method of claim 27, wherein said transporting of said portable alarm system comprises said portable alarm system being delivered to a user at a location of said user's choosing.

34. The method of claim 27, wherein said transporting of said portable alarm system comprises said user transporting said portable alarm system from a place of sale to said place to be protected.

35. The method of claim 27, further comprising the step of installing at least one smoke detector in said space to be protected, said at least one smoke detector adapted for wireless communication with said portable alarm system.

36. The method of claim 27, further comprising the step of installing at least one) remote motion sensor in said space to be protected, said at least one motion sensor adapted for wireless communication with said portable alarm system.

37. A method of providing alarm based security monitoring, said method comprising the steps of:

transmission of a signal from a portable alarm system in response to a security breach;

receipt of said signal by a gateway;

retention of said signal by said gateway; and transmission of said signal by said gateway to a first security monitoring company facility;

wherein said gateway is adapted to retransmit said signal to said first security monitoring company facility if said gateway does not receive confirmation of signal receipt from said first security monitoring company facility, and wherein said gateway is further adapted to transmit said signal to an alternate security monitoring company facility after a predetermined number of unsuccessful attempts to transmit said signal to said first security monitoring company facility.

38. The method of claim 37, further comprising the transmission of a confirmation of signal receipt to said portable alarm system by said gateway, upon the receipt by said gateway of a confirmation of signal receipt from said security monitoring company.

39. The method of claim 38, further comprising the indication by said portable alarm system of receipt of said confirmation of signal receipt from said gateway.

40. The method of claim 39, wherein an LED on said portable alarm system is used to provide said indication.

41. The method of claim 37, wherein said gateway will make at least two attempts to transmit said signal to said first security monitoring company facility before attempting to transmit said signal to an alternate security monitoring company facility.

42. The method of claim 37, wherein said security monitoring company attempts to contact the location of said portable alarm system in response to receipt of said signal.

43. The method of claim 37, wherein said security monitoring company contacts the proper local authorities in response to receipt of said signal.

44. The method of claim 37, wherein said signal from said portable alarm system includes an identifier, which enables said gateway to recognize said signal as originating from said portable alarm system.

45. The method of claim 44, wherein said gateway retains said signal based on the recognition of said identifier.

46. A method of providing alarm based security monitoring, said method comprising the steps of:

transmission of a signal from a portable alarm system in response to a security breach;

receipt of said signal by a gateway;

identification by said gateway of said portable alarm system as the origin of said signal;

retention of said signal by said gateway based on said identification;

transmission of said signal by said gateway to a first security monitoring company facility;

retransmission of said signal to said first security monitoring company facility if said gateway does not receive confirmation of signal receipt from said first security monitoring company facility; and transmission of said signal to an alternate security monitoring company facility after a predetermined number of unsuccessful attempts to transmit said signal to said first security monitoring company facility.

47. The method of claim 46, further comprising the transmission of a confirmation of signal receipt to said portable alarm system by said gateway, upon the receipt by said gateway of a confirmation of signal receipt from said security monitoring company.

48. The method of claim 47 further comprising the indication by said portable alarm system of receipt of said confirmation of signal receipt from said gateway.

49. The method of claim 48, wherein an LED on said portable alarm system is used to provide said indication.

50. The method of claim 46, wherein said gateway will make at least two attempts to transmit said signal to said first security monitoring company facility before attempting to transmit said signal to an alternate security monitoring company facility.

51. The method of claim 46, wherein said security monitoring company attempts to contact the location of said portable alarm system in response to receipt of said signal.

52. The method of claim 46, wherein said security monitoring company contacts the proper local authorities in response to receipt of said signal.

53. The method of claim 46, wherein said signal from said portable alarm system includes an identifier, which enables said gateway to recognize said signal as originating from said portable alarm system.

54. A method of providing alarm based security monitoring, said method comprising the steps of:

providing an alarm system, said alarm system comprising:

an enclosure;

a microprocessor secured within said enclosure;

a motion sensor in electrical communication with said microprocessor; and a wireless communication device secured within said enclosure and in electrical communication with said microprocessor;

detecting a security breach via said motion sensor;

transmitting a wireless alarm signal from said wireless communication device to a remote location in response to detection of a security breach by said motion sensor; and causing some action to occur in response to the receipt of said alarm signal at said remote location.

55. The method of claim 54, wherein said motion sensor is secured within said enclosure and is adapted to alert said microprocessor of a security breach upon the detection of a change in certain conditions within a zone outside of said enclosure.

56. The method of claim 54, further comprising a wireless receiver secured within said enclosure, said wireless receiver adapted to communicate with one or more wireless transmitting remote devices, and to alert said microprocessor of a security breach upon the receipt of an appropriate transmission therefrom.

57. The method of claim 56, wherein said one or more wireless transmitting remote devices includes a remote control.

58. The method of claim 56, wherein said one or more wireless transmitting remote devices includes a remote sensor.

59. The method of claim 54, wherein said remote location is a monitoring facility.

60. The method of claim 54, wherein said remote location is at least one personal communication device.

61. The method of claim 54, wherein said remote location is at least one e-mail address.

62. The method of claim 54, wherein said remote location is at least one internet URL.

63. The method of claim 54, wherein said alarm signal is transmitted to more than one remote location.

64. The method of claim 54, wherein a user of said alarm system is directly notified of an indication of a security breach.

65. The method of claim 54, wherein a user of said alarm system is notified of an indication of a security breach by an already notified entity.

66. The method of claim 54, wherein the proper authorities are contacted in response to receipt of said alarm signal.

67. The method of claim 54, further comprising the activation of an audible siren located within said enclosure to indicate a security breach.

68. The method of claim 54, further comprising the activation of a strobe light located on said enclosure to indicate a security breach.

69. The method of claim 54, further comprising a motion detector secured within said enclosure and in electrical communication with said microprocessor, said motion detector adapted to detect unauthorized movement of said enclosure and to alert said microprocessor accordingly.

70. The method of claim 69, further comprising transmitting a wireless alarm signal from said wireless communication device to a remote location in response to the detection of unauthorized movement of said enclosure by said motion detector.

* * * * *